US012331671B1

(12) United States Patent
Tsurumi

(10) Patent No.: US 12,331,671 B1
(45) Date of Patent: Jun. 17, 2025

(54) CONTROL DEVICE FOR VEHICLE

(71) Applicant: TOYOTA JIDOSHA KABUSHIKI KAISHA, Toyota (JP)

(72) Inventor: Kazuki Tsurumi, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/828,229

(22) Filed: Sep. 9, 2024

(30) Foreign Application Priority Data

Dec. 6, 2023 (JP) ..... 2023-206281

(51) Int. Cl.
*F01N 3/20* (2006.01)

(52) U.S. Cl.
CPC ..... *F01N 3/2026* (2013.01); *F01N 2240/16* (2013.01); *F01N 2900/1602* (2013.01)

(58) Field of Classification Search
CPC ..... F01N 3/2026; F01N 2240/16; F01N 2900/1602
See application file for complete search history.

(56) References Cited

U.S. PATENT DOCUMENTS 11,136,911 B2 * 10/2021 Nienhoff ..... F01N 11/002
2015/0033837 A1 * 2/2015 Niemeyer ..... F01N 11/002 73/114.75

FOREIGN PATENT DOCUMENTS

JP 2022-062890 A 4/2022

* cited by examiner

*Primary Examiner* — Brandon D Lee
(74) *Attorney, Agent, or Firm* — SoraIP, Inc.

(57) ABSTRACT

A vehicle control device controls a vehicle including an internal combustion engine, a filter, an electrically heated catalyst, a first temperature sensor, and a second temperature sensor. An exhaust passage of the internal combustion engine is provided with the electrically heated catalyst, the first temperature sensor, the filter, and the second temperature sensor from an upstream side to a downstream side, and the control device includes an energization control unit that controls energization of the electrically heated catalyst, and a detection unit that detects whether or not the filter is removed based on a first temperature that is a temperature detected by the first temperature sensor and a second temperature that is a temperature detected by the second temperature sensor, and when the detection unit performs detection, the energization control unit energizes the electrically heated catalyst.

5 Claims, 4 Drawing Sheets

CONTROL DEVICE FOR VEHICLE

CROSS-REFERENCE TO RELATED APPLICATION

This application claims priority to Japanese Patent Application No. 2023-206281 filed on Dec. 6, 2023, incorporated herein by reference in its entirety.

BACKGROUND

1. Technical Field

The present disclosure relates to a control device for a vehicle.

2. Description of Related Art

The exhaust of an internal combustion engine contains Particle Matter (PM). A filter that collects PM is provided in an exhaust passage (Japanese Unexamined Patent Application Publication No. 2022-062890 (JP 2022-062890 A), etc.).

SUMMARY

The filter is occasionally removed from the exhaust passage. It can be detected whether the filter is attached or detached based on the temperature of the exhaust. However, the accuracy of the detection is not sufficient. Thus, there is provided a control device for a vehicle capable of enhancing the accuracy in detecting whether a filter is removed.

An aspect provides a control device for a vehicle, the control device controlling the vehicle including an internal combustion engine, a filter, an electrically heated catalyst, a first temperature sensor, and a second temperature sensor, the electrically heated catalyst, the first temperature sensor, the filter, and the second temperature sensor being provided in an exhaust passage of the internal combustion engine from an upstream side to a downstream side, and the control device including:

an energization control unit that controls energization of the electrically heated catalyst; and a detection unit that detects whether the filter is removed based on a first temperature that is a temperature detected by the first temperature sensor and a second temperature that is a temperature detected by the second temperature sensor, in which the energization control unit energizes the electrically heated catalyst when the detection unit performs detection.

In the control device, the detection unit may determine that the filter is not removed when a difference between the first temperature and the second temperature is equal to or more than a predetermined value; and the detection unit may determine that the filter is removed when the difference between the first temperature and the second temperature is less than the predetermined value.

In the control device, the detection unit may perform the detection a predetermined time after the energization control unit starts the energization of the electrically heated catalyst.

In the control device, the energization control unit may perform the energization when the internal combustion engine is started, and the detection unit may perform the detection the predetermined time after the energization is started.

In the control device, the energization control unit may control energy input to the electrically heated catalyst.

It is possible to provide a control device for a vehicle capable of enhancing the accuracy in detecting whether a filter is removed.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
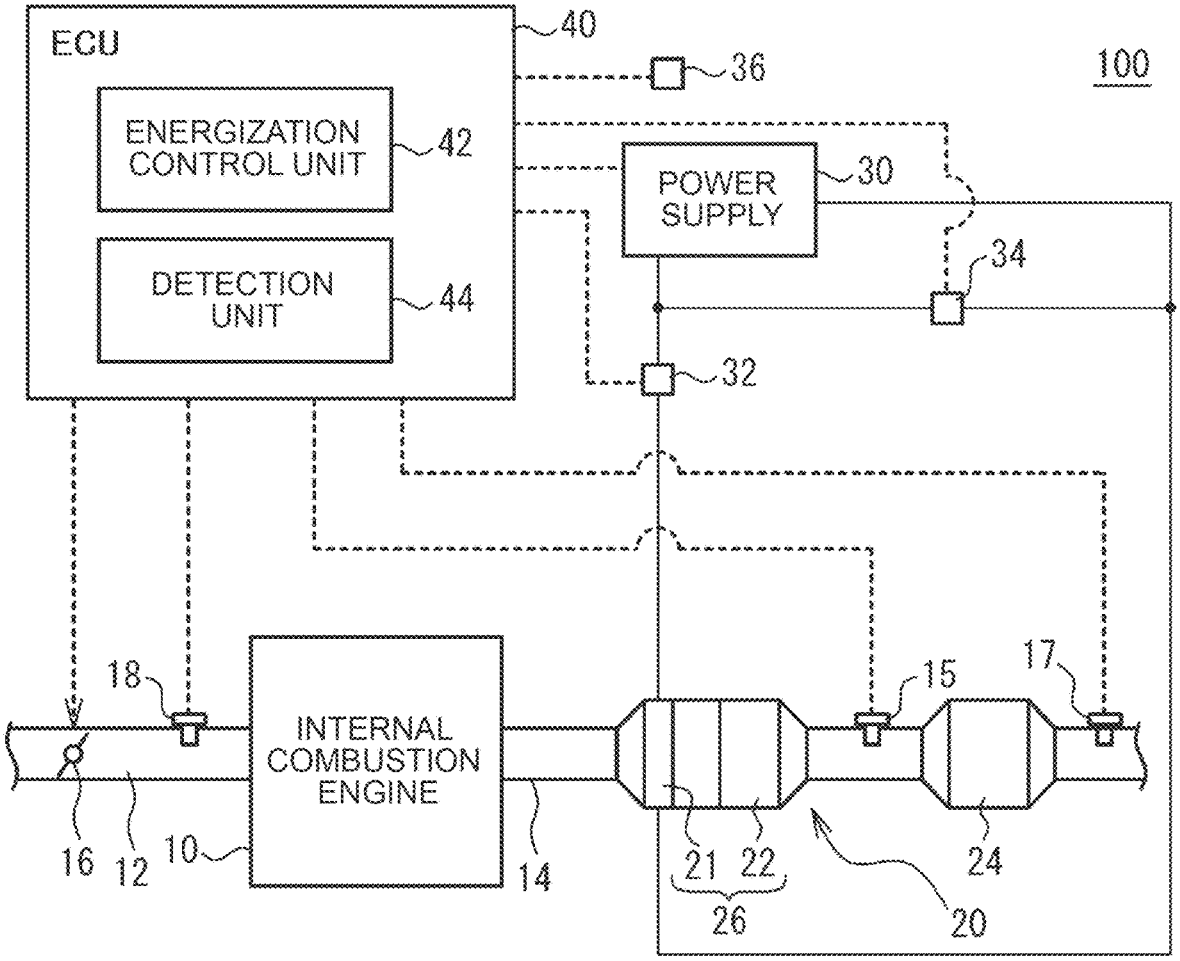
FIG. 1 is a diagram illustrating a vehicle according to an embodiment.

Hereinafter, a control device for a vehicle according to the present embodiment will be described with reference to the drawings. However, in the drawings, the dimensions, ratios, and the like of the respective parts may not be shown so as to completely coincide with the actual ones. Further, in some drawings, details are omitted. FIG. 1 is a diagram illustrating a vehicle 100 according to an embodiment. The vehicle 100 includes an internal combustion engine 10, an exhaust gas control apparatus 20, and an Electronic Control Unit (ECU) 40.

The internal combustion engine 10 combusts fuel such as gasoline to generate power. The water temperature sensor 36 detects the temperature of the coolant of the internal combustion engine 10. An intake passage 12 and an exhaust passage 14 are connected to the internal combustion engine 10. Air flows through the intake passage 12 and is introduced into the internal combustion engine 10. The intake passage 12 is provided with a throttle valve 16 and an air flow meter 18, which are arranged in this order from the upstream side. When the opening degree of the throttle valve 16 increases, the flow rate of air in the intake passage 12 increases. As the opening degree decreases, the flow rate of air decreases. The air flow meter 18 detects the flow rate of air.

The exhaust gas control apparatus 20 includes an electrically heated catalyst 26 and a Gasoline Particulate Filter (GPF) 24 (filters) to reduce exhaust from the internal combustion engine. The exhaust passage 14 is provided with an electrically heated catalyst 26, a temperature sensor 15 (first temperature sensor), a GPF 24, and a temperature sensor 17 (second temperature sensor) from the upstream side to the downstream side.

The electrically heated catalyst 26 includes a heater 21 and a catalyst 22. The heater 21 is located upstream of the catalyst 22. The heater 21 and the catalyst 22 are integrated on the same carrier. The catalyst 22 is, for example, a three-way catalyst and purifies materials such as carbon monoxide (CO) and nitrogen oxides (NOx). The heater 21 includes a metal and has higher conductivity than the wall of the exhaust passage 14. The heater 21 may be, for example, a catalyst having a heater function. That is, the heater 21 may have only a function of heating, or may have both a function of heating and exhaust gas purification.

The power supply 30 includes, for example, a battery and a current-voltage source. The power supply 30 is electrically connected to the heater 21. A current sensor 32 and a voltage sensor 34 are provided in the wiring connecting the power supply 30 and the heater 21. The current sensor 32 is connected in series with the heater 21, and detects a current flowing through the heater 21. The voltage sensor 34 is connected in parallel with the heater 21, and detects a voltage applied to the heater 21.

The heater 21 generates heat by energization. As the heat of the heater 21 is transferred to the catalyst 22, the temperature of the catalyst 22 increases. The catalyst 22 is activated by the temperature increase, and the purification rate is increased. GPF 24 collects PM in the evacuation.

The temperature sensor 15 detects a temperature (first temperature) of the exhausted air between the electrically heated catalyst 26 and GPF 24. The temperature sensor 17 detects the exhaust temperature (second temperature) on the downstream side of the filter 24.

Exhaust gas prior to inflow into GPF 24 flows through the temperature sensor 15. Exhaust gas after passing through GPF 24 flows through the temperature sensor 17. Some of the heat from the exhaust is lost to GPF 24. Therefore, in general, the temperature detected by the temperature sensor 17 is lower than the temperature detected by the temperature sensor 15. A temperature difference occurs between the two temperature sensors. When GPF 24 is removed, the heat of the exhaust is not absorbed by GPF 24. Therefore, the temperature difference between the two temperature sensors becomes small.

ECU 40 is a control device for vehicles. ECU 40 comprises storage devices such as Central Processing Unit (CPU), Random Access Memory (RAM) and Read Only Memory (ROM). ECU 40 is a control device that performs various kinds of control by executing a program stored in a ROM or a storage device.

ECU 40 controls the opening degree of the throttle valve 16. ECU 40 acquires the flow rate (intake air amount) of the air from the air flow meter 18, and estimates the flow rate of the exhaust air based on the intake air amount. ECU 40 acquires the temperature detected by the temperature sensor 15, the temperature detected by the temperature sensor 17, and the water temperature detected by the water temperature sensor 36.

ECU 40 functions as the energization control unit 42 and the detection unit 44. The energization control unit 42 controls on/off of energization of the electrically heated catalyst 26, the energization time, and the energy input to the electrically heated catalyst 26. The energization control unit 42 acquires a current detected by the current sensor 32 and acquires a voltage detected by the voltage sensor 34. The energization control unit 42 controls the electric power input from the power supply 30 to the heater 21, and controls the amount of heat generated by the heater 21. For example, the energization control unit 42 controls the power so that the electrically heated catalyst 26 is at an appropriate temperature.

The detection unit 44 acquires a difference (temperature difference dT) between the temperature detected by the temperature sensor 15 and the temperature detected by the temperature sensor 17, and detects whether or not GPF 24 is removed from the exhaust passage 14 based on the temperature difference dT.

Figure 2:
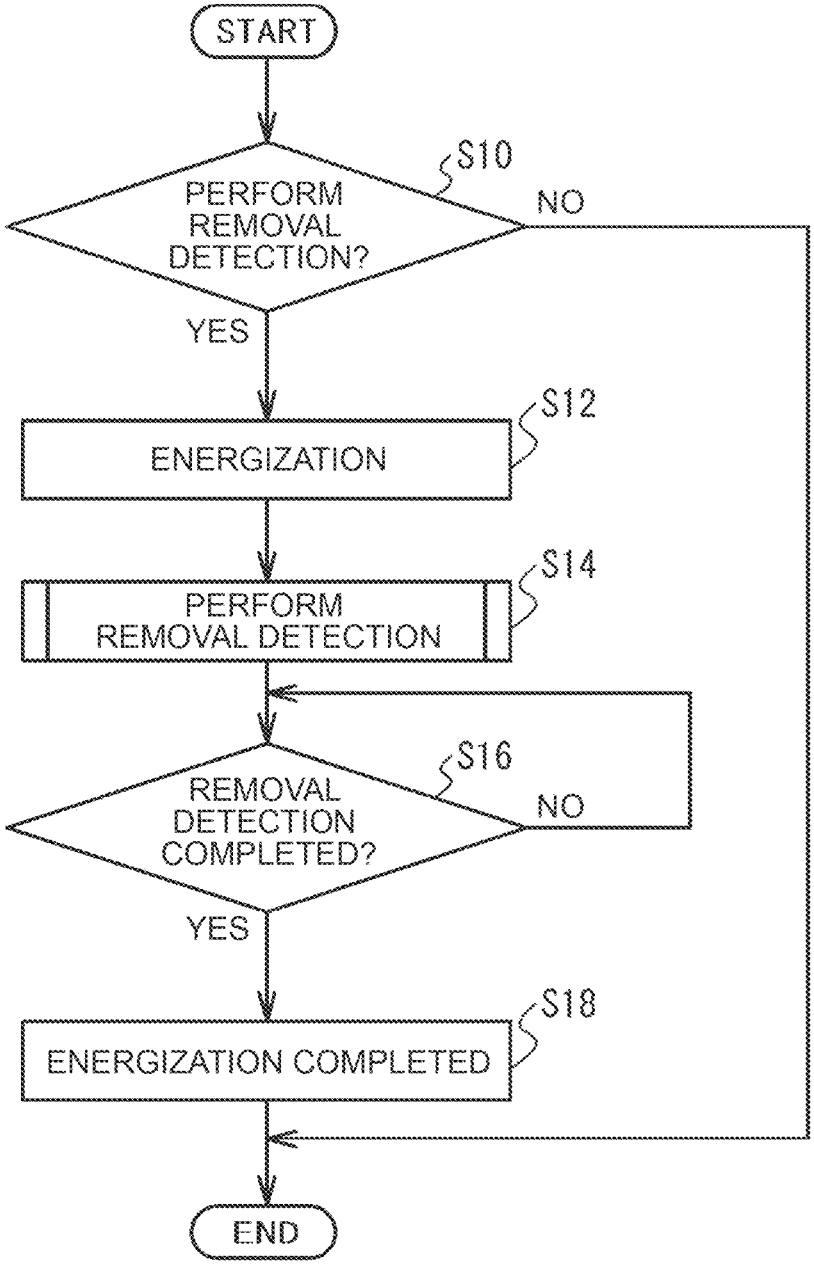
FIG. 2 is a flow chart illustrating a process performed by ECU.
Figure 3:
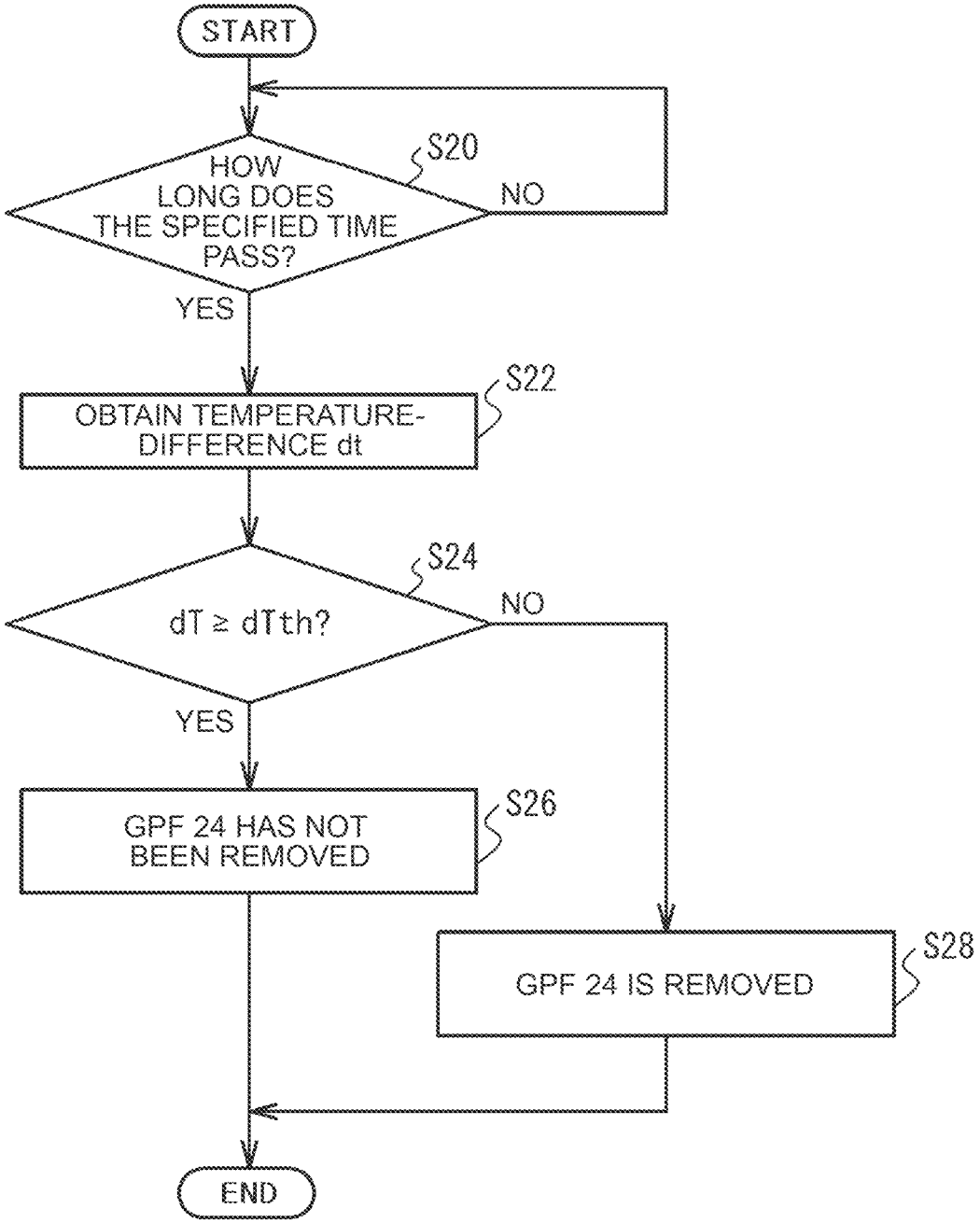
FIG. 3 is a flow chart illustrating a process performed by ECU.

FIG. 2 and FIG. 3 are flow charts illustrating processes executed by ECU 40. As shown in FIG. 2, ECU 40 determines whether or not to perform GPF 24 removal detecting (S10). For example, if the temperature sensor fails immediately after the removal detection is performed, a negative determination (No) is made, and the process ends. If the removal is detected, an affirmative determination (Yes) is made. For example, the condition is that a predetermined time has elapsed from the previous detachment detection, that the temperature sensor is normal, that the temperature such as the water temperature is within an appropriate range, and the like. The removal detection may be performed immediately after the start of the internal combustion engine 10.

If an affirmative determination is made in S10, the energization control unit 42 energizes the heater 21 of the electrically heated catalyst 26 (S12). The detection unit 44 performs GPF 24 removal detecting (S14).

FIG. 3 is a flowchart illustrating removal detection. The detection unit 44 determines whether or not a predetermined period has elapsed from the beginning of energization (S20). If the determination is negative, S20 is repeated until the elapse of the period. If the determination is affirmative, the detection unit 44 acquires a difference (temperature difference dT) between the temperature detected by the temperature sensor 15 and the temperature detected by the temperature sensor 17 (S22). The detection unit 44 determines whether or not the temperature-difference dT is equal to or greater than a predetermined value dTth (S24).

When the temperature-difference dT is equal to or larger than the threshold dTth, an affirmative determination is made in S24. The detection unit 44 determines that GPF 24 has not been removed (S26). When the temperature-difference dT is less than the threshold dTth, a negative determination is made in S24. The detection unit 44 determines that GPF 24 has been removed (S28). After S26 or S28, the process of FIG. 3 ends.

As illustrated in FIG. 2, the energization control unit 42 determines whether or not the detachment detection is completed (S16). If a negative determination is made, S16 is repeated. If the determination is affirmative, the energization control unit 42 ends the energization (S18). Thus, the process ends.

Figure 4:
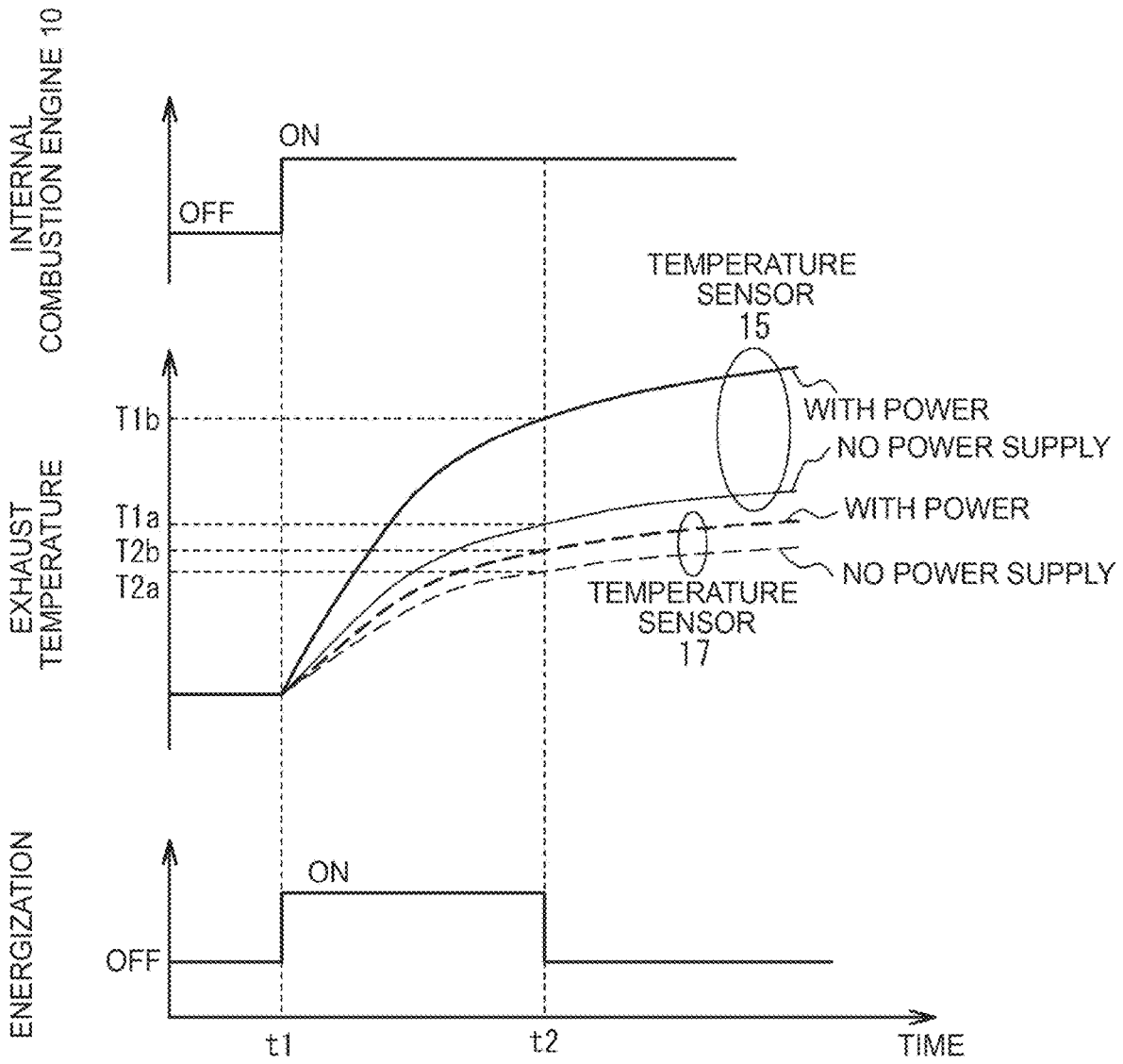
FIG. 4 is a diagram illustrating a time chart.

FIG. 4 is a diagram illustrating a time chart. The operation state of the internal combustion engine 10, the exhaust temperature, and the energization state of the electrically heated catalyst 26 from the upper stage are shown.

The internal combustion engine 10 is switched from on-to-off t1 times. The energization control unit 42 turns on the energization of the electrically heated catalyst 26, and conducts energization from t1 to t2 (S12 in FIG. 2). The detection unit 44 waits until the time elapses (S20 in FIG. 3). The detection unit 44 acquires the exhausted temperature in the temporal t2 and calculates the temperature differential dT (S22).

Four types of temperatures are shown as exhaust temperatures in FIG. 4. The solid line indicates the temperature detected by the temperature sensor 15. The thin solid line represents the temperature when the electric current is not supplied to the electrically heated catalyst 26. The thick solid line is the temperature when energized. The broken line indicates the temperature detected by the temperature sensor 17. The thin broken line indicates the temperature when no current is supplied. The thick dashed line is the temperature when energized. In the embodiment of FIG. 4, GPF 24 is attached to the exhaust passage 14.

Even when the electric current is not supplied, the temperature increases due to the heat of the exhaust gas. In the case of energization, heat is also generated from the heater 21, so that the temperature rises to a higher value.

The detection unit 44 calculates a temperature difference dT from the temperature in the time t2. When the current is not supplied, the temperature detected by the temperature sensor 15 is T1*a*. The temperature detected by the temperature sensor 17 is T2*a*. When energized, the temperature detected by the temperature sensor 15 is T1*b*. The temperature detected by the temperature sensor 17 is T2*b*. The temperature T1*b* is higher than the temperature T1*a*. The temperature T2*b* is higher than the temperature T2*a* and lower than the temperature T1*a*.

The detection unit 44 calculates a difference between the temperature T1*b* and the temperature T2*b*, and sets the difference as a temperature difference dT. The detection unit 44 compares the temperature-difference dT with the predetermined dTth to detect removal of GPF 24 (S24).

As shown by the thin lines in FIG. 4, differences also occur between the temperature T1*a* and the temperature T2*a*. However, the temperature difference is smaller than the example of the thick line. For example, the temperature difference varies depending on how the exhaust gas is applied to the temperature sensor, the condensed water, and the like. When the exhaust gas hardly hits the temperature sensor 15 and hits the temperature sensor 17 in a large amount, the detection value T1*a* of the temperature sensor 15 becomes low, and the detection value T2*a* of the temperature sensor 17 becomes high. The temperature difference decreases. Water in the exhaust gas may condense to form condensed water. When the temperature sensor 15 contacts the condensed water, the temperature T1*a* decreases and the temperature differential decreases. As the temperature difference decreases, the accuracy of the detachment detection may decrease.

According to the present embodiment, the detection unit 44 detects removal of GPF 24 based on the temperature detected by the temperature sensor 15 and the temperature sensor 17. When the removal detection is performed, the energization control unit 42 energizes the heater 21 of the electrically heated catalyst 26. The exhaust gas heated by the heater 21 flows to the temperature sensor 15 and the temperature sensor 17. The temperature differential dT between the two temperature sensors when energized is larger than when not energized. Increasing the differential dT increases the accuracy of the removal detection.

When the temperature-difference dT is equal to or greater than the predetermined value dTth, the detection unit 44 determines that GPF 24 has not been removed (S26). When the temperature-difference dT is less than the predetermined value dTth, it is determined that GPF 24 is removed (S28). In order to improve the accuracy of the detachment detection, it is essential that the temperature-difference dT is changed depending on the presence or absence of GPF 24.

The electrically heated catalyst 26 heats the exhaust upstream of GPF 24. The temperature T1*b* detected by the temperature sensor 15 increases. When GPF 24 is mounted, GPF 24 absorbs a portion of the heat of the exhaust. The temperature of the exhaust gas flowing downstream of GPF 24 is suppressed. The temperature T2*b* detected by the temperature sensor 17 is lower than that of T1*b*. The temperature-difference dT increases. When GPF 24 is removed, heat is not exchanged by GPF 24, and the exhaust gas heated by the heater 21 flows to the temperature sensor 15 and the temperature sensor 17. The temperature-difference dT is reduced. This increases the accuracy of the removal detection.

The detection unit 44 calculates a temperature differential dT from a temperature after a predetermined period of time from when the electric current to the electrically heated catalyst 26 is started, and performs removal detection. As shown in FIG. 4, the exhaust temperature after an appropriate time has elapsed from the energization is higher than the exhaust temperature immediately after the start of the energization. In particular, the temperature T1*b* detected by the temperature sensor 15 greatly increases. The thermal differential dT is enlarged, and the accuracy of the detachment detecting is improved.

GPF 24 may be removed or replaced while the internal combustion engine 10 is stopped. Further, the temperature of the vehicle decreases while the internal combustion engine 10 is stopped. For example, since the temperature of the exhaust passage 14 is low at the time of cold start, condensed water is likely to be generated in the exhaust passage 14. The temperature sensor is highly likely to be exposed to water. As shown in FIG. 4, immediately after the start of the internal combustion engine 10, the electric current is supplied to the electrically heated catalyst 26, and the removal detection is performed. GPF 24 can be effectively detected.

The energization control unit 42 controls the energy input to the heater 21 of the electrically heated catalyst 26. For example, the energization control unit 42 may control the voltage and the current to adjust the input power to the heater 21, or may adjust the energization time. The temperature of the exhaust can be controlled.

As described above, when condensed water is generated, the accuracy of removal detection tends to decrease. For example, when the water temperature detected by the water temperature sensor 36 is around 0° C., the energization control unit 42 increases the energy. Accuracy of removal detection is increased. When the water temperature is high, the outside air temperature is high, and GPF 24 is also considered to be high. It is difficult for GPF 24 to be heated by exhausting, and it is difficult to generate a thermal differential. The energization control unit 42 increases the energy. The thermal differential dT is enlarged, and the accuracy of the detachment detection is increased.

Since the exhaust gas is heated by using the heater 21 of the electrically heated catalyst 26, a new heater may not be provided. Increases in costs are suppressed. The target to be removed and detected may be any filters that collect PM.

Although the preferred embodiment of the disclosure is described above in detail, the disclosure is not limited to the specific embodiment, and various modifications and changes may be made within the scope of the disclosure described in claims.

What is claimed is:

1. A control device for a vehicle, the control device controlling the vehicle including an internal combustion engine, a filter, an electrically heated catalyst, a first temperature sensor, and a second temperature sensor, the electrically heated catalyst, the first temperature sensor, the filter, and the second temperature sensor being provided in an exhaust passage of the internal combustion engine from an upstream side to a downstream side, and the control device comprising:

an energization control unit that controls energization of the electrically heated catalyst; and a detection unit that detects whether the filter is removed based on a first temperature that is a temperature detected by the first temperature sensor and a second temperature that is a temperature detected by the second temperature sensor, wherein the energization control unit energizes the electrically heated catalyst when the detection unit performs detection.

2. The control device according to claim 1, wherein:

the detection unit determines that the filter is not removed when a difference between the first temperature and the second temperature is equal to or more than a predetermined value; and the detection unit determines that the filter is removed when the difference between the first temperature and the second temperature is less than the predetermined value.

3. The control device according to claim 1, wherein the detection unit performs the detection a predetermined time after the energization control unit starts the energization of the electrically heated catalyst.

4. The control device according to claim 3, wherein the energization control unit performs the energization when the internal combustion engine is started, and the detection unit performs the detection the predetermined time after the energization is started.

5. The control device according to claim 1, wherein the energization control unit controls energy input to the electrically heated catalyst.

* * * * *